US006601981B2

(12) United States Patent
Wilski

(10) Patent No.: US 6,601,981 B2
(45) Date of Patent: Aug. 5, 2003

(54) HEADLIGHT ASSEMBLY

(75) Inventor: Lawrence F. Wilski, Macomb Township, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/995,376

(22) Filed: Nov. 26, 2001

(65) Prior Publication Data

US 2003/0099112 A1 May 29, 2003

(51) Int. Cl.[7] ..... F21V 11/00

(52) U.S. Cl. ..... 362/510; 362/539; 362/307; 362/311; 362/328

(58) Field of Search ..... 362/510, 539, 362/307, 311, 328, 327, 304, 305, 302, 293, 517, 518

(56) References Cited

U.S. PATENT DOCUMENTS 4,586,116 A * 4/1986 Kasboske ..... 362/293
4,807,094 A 2/1989 Mateos et al.
5,010,458 A 4/1991 Fraizer
5,357,407 A * 10/1994 Woods ..... 362/508
5,383,102 A 1/1995 Jones
5,539,629 A 7/1996 Chinniah et al.
5,855,430 A 1/1999 Coushaine et al.
6,142,657 A 11/2000 Hinich et al.
6,152,589 A * 11/2000 Kawaguchi et al. ..... 362/518

* cited by examiner

*Primary Examiner*—Stephen Husar
*Assistant Examiner*—Sharon Payne
(74) *Attorney, Agent, or Firm*—Brinks Hofer Gilson & Lione

(57) ABSTRACT

The present invention is generally directed towards a headlight assembly installed in a motor vehicle. The headlight assembly includes a reflector member, a light source and a light shield. In order to give the appearance during daytime that the reflector member is colored, the headlight assembly is provided with a colored ring around the reflector member. Additionally, the light shield is also coated with the same color.

18 Claims, 2 Drawing Sheets

HEADLIGHT ASSEMBLY

TECHNICAL FIELD OF THE INVENTION

This invention relates to lighting system in automobiles. More specifically, this invention relates to a headlight assembly installed in automobiles.

BACKGROUND OF THE INVENTION

Conventionally, a motor vehicle have either one or two pairs of headlights that perform the function of illuminating a drivers filed of vision. The headlights are generally illuminated at night and extinguished in daylight. However, today there is a tendency to have the headlights lit in daylight, not in order to illuminate the driver's field of vision, but rather in order to provide a strong signaling or indicating function to pedestrians or to other vehicles. This function of illuminating daytime light is commonly referred to as that of a "day running light".

In order to give the required reduced light intensity to headlight driving beams for use in daylight, it is known to energize the filament lamps of such headlights at a lower voltage, which is typically only a few volts, than their nominal supply. Therefore, when a headlight is used in daylight driving in its dipped mode, which involves a reduction in the supply voltage of its filament lamp, then the light is used in the dipped mode far more than in its main beam mode. As a result, the lamps (or the filaments in the case of twin function lamps) which provide the dipped beam function will fail much sooner than those lamps or filaments which are dedicated to the main beam function.

In addition, in the case where dipped beam headlights are of the elliptical type it is found that the required daylight signaling function is not at all satisfactory. In particular, in full sunlight, an observer who is a few meters or tens of meters in front of the vehicle is in danger of not even being able to see that the headlights are lit.

Therefore, there in a need in the automotive industry to provide headlamp that give the visual appearance during the day that these headlamps are be colored, without the headlamp bulb being turned on. There is also a need to provide headlamps such that when the actual lamp is used and the lights are turned on, there is no interference with the color and the performance of the bulb, or performance of the headlamp is not compromised.

SUMMARY OF THE INVENTION

In accordance with the preferred embodiment of the present invention, a headlight assembly installed in a motor vehicle has reflective capabilities during daytime. Preferably, the headlight assembly is provided with a reflector surface, a light source and a light shield surrounding the light source to provide tint to the light source. In order to reflect light during daytime, the reflector is provided with a colored ring. Additionally, the light shield is also colored such that the colored ring and the light shield are of the same color.

Therefore, during daytime when natural light reflects off the headlight assembly, the reflector gives the appearance of the having the same color as the colored ring and the light shield.

BRIEF DESCRIPTION OF THE DRAWINGS

Further features of the invention will become apparent from the following discussion and the accompanying drawings in which.

DETAILED DESCRIPTION OF THE PREFERRED EMBODIMENT

Figure 1:
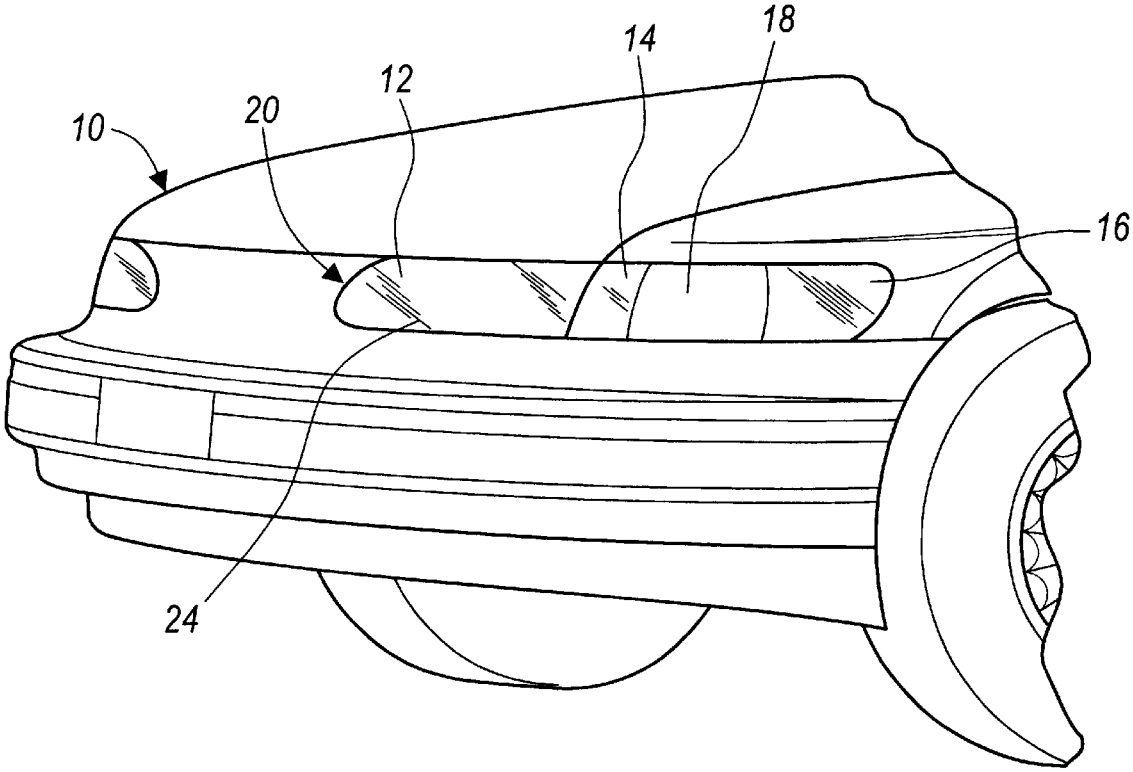
FIG. 1 is a front view of a motor vehicle incorporating the headlight assembly of the present invention.

The following description of the preferred embodiment is merely exemplary in nature and is in no way intended to limit the invention or its application or uses.

Referring in particular to the drawings, a motor vehicle having the headlight assembly of the present invention is generally shown and designated by reference numeral 10.

As shown in FIG. 1, the motor vehicle 10 includes a headlight assembly 12, a turn signal 14, a cornering lamp 16 and a retro reflector 18. As shown in FIG. 1, the headlight assembly 12 is installed in the front of the motor vehicle. The headlight assembly 12 is used to illuminate a horizontal planar surface (not shown) in front of the motor vehicle 10. Further, the headlight assembly 12 is housed in a housing 20 that is connected to the motor vehicle 10.

Figure 2:
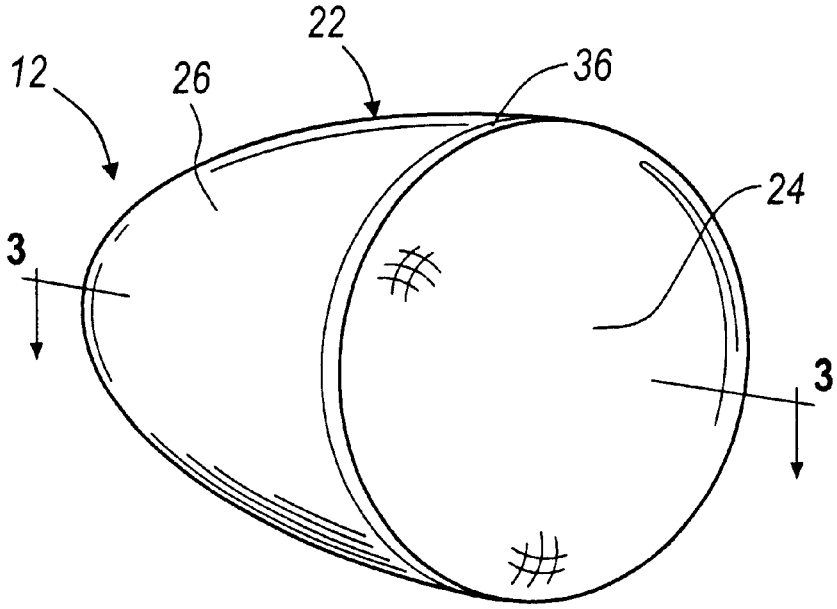
FIG. 2 is a side view of the headlight assembly in accordance with the teachings of the present invention.
Figure 3:
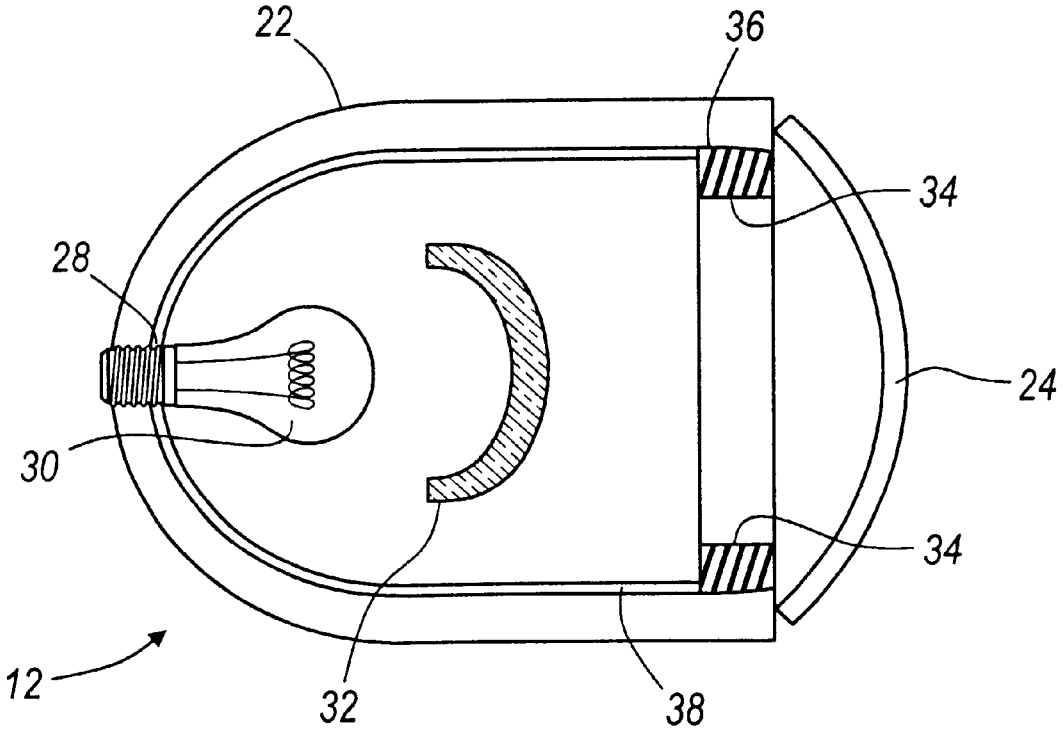
FIG. 3 is a cross sectional view of the headlight assembly in accordance with the teachings of the present invention.

Referring in particular to FIGS. 2 and 3, the headlamp assembly 12 includes a reflector member 22 the open end of which is adapted to closed by a lens 24. The lens 24 is a colorless glass or plastic. Preferably, the reflector member 22 is metallic compound, a plastic compound or any other suitable material. The contour of the reflector member 22 yields the contour of the headlight assembly 12 and is therefore preferably configured in a contour, which is aesthetically pleasing and complimentary to the location on the motor vehicle 10. The reflector member 22 is preferably polycarbonate, nylon, ABS (Acrylonitrile-butadiene-styrene copolymer), BMC (Bulk Molding Compound, a polyester based thermoset) or polyetherimide or the like.

With continued reference to FIGS. 2 and 3, the reflector member 22 includes a parabolic reflector portion 26. The reflector member 22 also defines a cavity portion 28 for supporting a light source 30, such as a bulb (as shown in FIG. 3). The. light source 30 provides a light beam (not shown). A portion of the light beam from the light source 30 strikes the parabolic portion 26 before exiting the lens 24. In addition, a portion of the light beam exits the lens 24 without striking the parabolic portion 26. A light shield 32 provides the tint and directs the light beam from the light source 30 surrounds the light source 30. Although not shown in the drawings the light shield 32 surrounds the light source 30 and is connected to the reflector member 22.

Referring in particular to FIG. 3, in order to give the appearance that the headlight assembly 12 is illuminated during the daytime without the light source 30 turned on, the headlight assembly 12 is provided with a ring 34. Preferably, the ring 34 is installed around the circumference 36 in an interior surface 38 of the reflector member 22. The ring 34 is installed near the lens 24 of the headlight assembly 12. Preferably the ring 34 is separate from reflector member 22 such that it attaches to the reflector member 22 with the help of an adhesive. Alternatively, the ring 34 may be insert molded and integrally formed with the reflector member 22. In the preferred embodiment, the ring 34 is made of the same materials as the reflector member 22. Alternatively, it could be formed of a metal or any other material.

In order for the headlight assembly 12 to give the illusion of being lit during daytime, the ring 34 is preferably coated with a desired color. The method of coating the ring 34 is well known in the art and is not explained in detail in this invention. A number of techniques such as vapor deposition process, a sputtering technique, or other techniques may be used to color the ring 34. The ring 34 may be coated with the desired color before instillation in the headlamp assembly 12 or may be coated with a desired color after being installed on the reflector member 22. Preferably, the ring 34 is coated with a copper-aluminum alloy layer. Other metal may also be deposited on the ring to give a desired color. For example, other metal such as chromium, cobalt, silver or even alloys of these metals could be used to give the ring the desired color. Preferably, the ring 34 has a golden appearance. As used herein, the term "golden" is taken to include those appearances such as gold, yellow gold as used in the jewelry industry, bronze or brass appearances. Alternatively, the ring 34 could also have other appearance for example, green, blue, red or any other desired color.

In order to improve the appearance that the reflector member 22 has the same color as the ring 34, the light shield 32 also coated with the same metal or a metal alloy as the ring 34. Therefore, both the ring 34 and the light shield 32 have the same color, thereby giving the appearance that reflector member 22 has the same color as the ring 34.

As shown in FIG. 3, in order to increase the reflectivity of the reflector member 22, the entire interior surface 38 of the reflector member 22 is coated with a highly reflective material such as aluminum. As discussed above, the headlight assembly 12 during daytime appears to have some color due to the presence of a colored ring 34 around the reflector member 22 and the color of the light shield 32. However, when the light source 30 is turned on, the presence of the colored ring 34 does not hinder the performance of the headlight assembly 12.

As any person skilled in the art will recognize from the previous description and from the figures and claims, modifications and changes can be made to the preferred embodiment of the invention without departing from the scope of the invention as defined in the following claims.

What is claimed is:

1. A headlight assembly comprising:

a light source to emit a light beam;

a reflector having an interior surface, wherein the interior surface reflects the light beam emitted from the light source;

a light shield around the light source such that the light shield provides a tint to the light source; and a colored ring attachable to and surrounding the interior surface of the reflector, wherein the interior surface of the reflector reflects color of the colored ring such that the headlight assembly gives an appearance of emitting light, without the light source emitting the light beam.

2. The headlight assembly of claim 1, wherein the color on the colored ring is golden.

3. The headlight assembly of claim 1, wherein the light shield is coated with the same color as the colored ring.

4. The headlight assembly of claim 1, wherein the colored ring is insert molded to the reflector.

5. The headlight assembly of claim 1, wherein the interior surface of reflector is coated with a highly reflective material.

6. The headlight assembly of claim 5, wherein the highly reflective material is aluminum.

7. A headlight assembly installed in a motor vehicle comprising:

a light source to emit a light beam;

a reflector having an interior surface, wherein the interior surface reflects the light beam emitted from the light source;

a lens attachable to one end of the reflector;

a light shield around the light source such that the light shield provides a tint to the light source; and a colored ring attachable to and surrounding the interior surface of the reflector;

wherein the colored ring and the light shield have the same color such that during daytime the reflector reflects the color of the colored ring and the light shield, such that the headlight assembly appears to emit the light beam without the light source emitting the light beam.

8. The headlight assembly of claim 7, wherein the color on the colored ring and the light shield is golden.

9. The headlight assembly of claim 7, wherein the colored ring is insert molded to the reflector.

10. The headlight assembly of claim 7, wherein the reflector is coated with a highly reflective material.

11. The headlight assembly of claim 10, wherein the highly reflective material is aluminum.

12. A method of forming a headlight assembly installed in a motor vehicle, the method comprising:

providing a light source to emit a light beam;

providing a reflector having an interior surface, wherein the interior surface reflects the light beam emitted from the light source;

providing a light shield around the light source such that the light shield provides a tint to the light source;

inserting a colored ring around the interior surface of the reflector; and reflecting color of the colored ring by the interior surface of the reflector, such that the headlight assembly appears emitting the light beam without the light source emitting the light beam.

13. The method of claim 12, further comprising the step of coating the reflector with a highly reflective material before inserting the colored ring.

14. The method of claim 13, wherein the highly reflective material is aluminum.

15. The method of claim 12, wherein the color of the colored ring and the light shield is golden.

16. The headlight assembly of claim 1, further comprising a lens attached to one end of the reflector.

17. The headlight assembly of claim 16, wherein the lens is formed of plastic or glass.

18. The headlight assembly of claim 7, wherein the lens is formed of plastic or glass.

* * * * *